United States Patent [19]

Matthews

[11] 4,135,348

[45] Jan. 23, 1979

[54] FASTENING DEVICE FOR RELEASABLY OR NON-RELEASABLY FASTENING PARTS OF A HALTER TO EACH OTHER

[75] Inventor: Thomas A. Matthews, Richmond, Va.

[73] Assignee: B. T. Crump Company, Inc., Richmond, Va.

[21] Appl. No.: 813,304

[22] Filed: Jul. 6, 1977

[51] Int. Cl.[2] ..... B68B 1/02

[52] U.S. Cl. ..... 54/24

[58] Field of Search ..... 54/6 R, 6 A, 24, 70, 54/85; 119/29, 96, 106, 109; 128/DIG. 15

[56] References Cited

U.S. PATENT DOCUMENTS

| | | | |
|---|---|---|---|
| 896,164 | 8/1908 | Schreiter | 54/24 |
| 3,535,719 | 10/1970 | Murcott | 128/DIG. 15 |
| 3,605,384 | 9/1971 | Pacini | 119/96 X |

*Primary Examiner*—Louis G. Mancene
*Assistant Examiner*—Robert P. Swiatek
*Attorney, Agent, or Firm*—Fleit & Jacobson

[57] ABSTRACT

A fastening device for releasably or non-releasably fastening free ends of two parts of a neck strap or crown jam of a halter to each other. Each of the two parts has one end fixedly connected to another part of the halter and one end free. A free end of one of the neck strap parts is connected to a buckle. The free end of the other neck strap part is formed of two overlapping straps. Both straps near their free ends contain a plurality of aligned holes, a selected pair of which are engageable by the buckle to non-releasably fasten the ends of the two parts of the neck strap or crown jam to each other. A two-section releasable fastener is attached to one of the surfaces of the two straps near its free end. The two sections are engaged with each other when the strap is passed through the buckle and folded back on itself. The engaged sections resist separation upon application of longitudinal tensile forces of ordinary value, but when the magnitude of any such force exceeds a predetermined value, they separate. With the ends of the two parts of the neck strap of the halter releasably or non-releasably fastened to each other, the halter can be releasably or non-releasably secured around the head and a portion of the neck of an animal.

4 Claims, 5 Drawing Figures

FASTENING DEVICE FOR RELEASABLY OR NON-RELEASABLY FASTENING PARTS OF A HALTER TO EACH OTHER

BACKGROUND OF THE INVENTION

1. Field of the Invention

This invention relates generally to an improved halter having a fastening device for releasably or non-releasably fastening ends of two parts of a neck strap to each other. More particularly, this invention relates to an improved halter that can be fastened around the head and a portion of the neck of an animal in such manner that it will remain fastened until part of the halter breaks. Alternatively, the halter can be fastened to release prior to breaking by the application of a longitudinal force exceeding a predetermined value.

2. Description of the Prior Art

Halters for use with animals, such as horses, generally comprise a plurality of straps adapted to removably encircle the head and a portion of the neck of the animal to provide a convenient means for leading and tying the animal. The halter when once applied is often not removed for long periods, and it is customary to permit the animal with its halter thereon to graze free in large fields and areas that are often remotely located. As a consequence thereof, it sometimes happens that the halter becomes entangled or ensnared in fences, shubbery, tree branches and the like, where upon the animal remains confined thereat until found and released upon its absence being noted. Also, when playing or scratching itself, the animal sometimes entangles a leg in the halter. If the animal's difficulty is not discovered for long periods, it can result in loss of the animal.

To overcome this problem with conventional halters, it has been proposed in U.S. Pat. No. 3,605,384 to provide a breakaway halter to enable the animal to free itself therefrom should the halter become entangled in a fence or tree branch, or should a leg of the animal become caught in the halter. The halter discloses in the referenced patent includes both a nose strap and a neck strap respectively encircling the nose and neck of the animal. The neck strap has free end portions adapted to overlay each other when circling the animal's neck. These free end portions are equipped with stress releasable means for detachably interconnecting the free end portions, and such releasable means is generally effective to resist separation of the free end portions upon application of longitudinal tensile forces of ordinary value, but when the magnitude of any such force exceeds a predetermined value, separation occurs to free the animal from the halter.

The breakaway halter just described functions quite satisfactorily as a releasable halter; however, a problem is encountered when it is desired to non-releasably fasten the halter, for instance, when it is desired to train or ride the animal. In such instances, the breakaway halter must be removed and replaced with a non-releasable halter. The need to change halters can be a significant inconvenience and can result in the non-releasable halter being left on the animal when the animal is permitted to graze free or the breakaway halter used when a non-releasable halter should be used.

SUMMARY OF THE INVENTION

Accordingly, the present invention provides an improved halter that overcomes the problems encountered with use of the prior art halters. The improved halter of the present invention can be releasably or non-releasably fastened around the head and a portion of the neck of an animal such as a horse.

The improved halter uses a fastening device for releasably or non-releasably fastening free ends of two parts of a neck strap of a halter to each other. Each of the two parts has one end fixedly connected to another part of the halter and one end free. A free end of one of the neck strap parts is connected to a buckle. The free end of the other neck strap part is formed of a first longitudinally-extending strap that contacts the animal and a second separate longitudinally-extending strap that overlaps the first strap. Both straps near their free ends contain a plurality of aligned holes, a selected pair of which are engageable by the buckle to non-releasably fasten the ends of the two parts of the neck strap to each other. A two-section releasable fastener is attached to the surface of the second strap near the free end that faces the first strap, the two sections being spaced from each other in a longitudinal direction. The two sections, when engaged with each other, resist separation upon application of longitudinal tensile forces of ordinary value, but when the magnitude of any such force exceeds a predetermined value, separation of the two sections occurs. The end of the second strap containing the releasable fastener is fed through the buckle and folded back on itself in such manner that none of the holes in the strap are engaged by the buckle and one of the sections of the releasable fastener is engaged with the other section. With the sections of the releasable fastener so engaged, the free ends of the two parts of the neck strap are releasably fastened to each other. With the ends of the two parts of the neck strap of the halter releasably or non-releasably fastened to each other, the halter can be releasably or non-releasably secured around the head and a portion of the neck of an animal.

BRIEF DESCRIPTION OF THE DRAWINGS

In order that the invention may be more fully understood and readily carried into effect, it will now be described by way of example with reference to the accompanying drawings, in which.

DESCRIPTION OF THE PREFERRED EMBODIMENT

Figure 1:
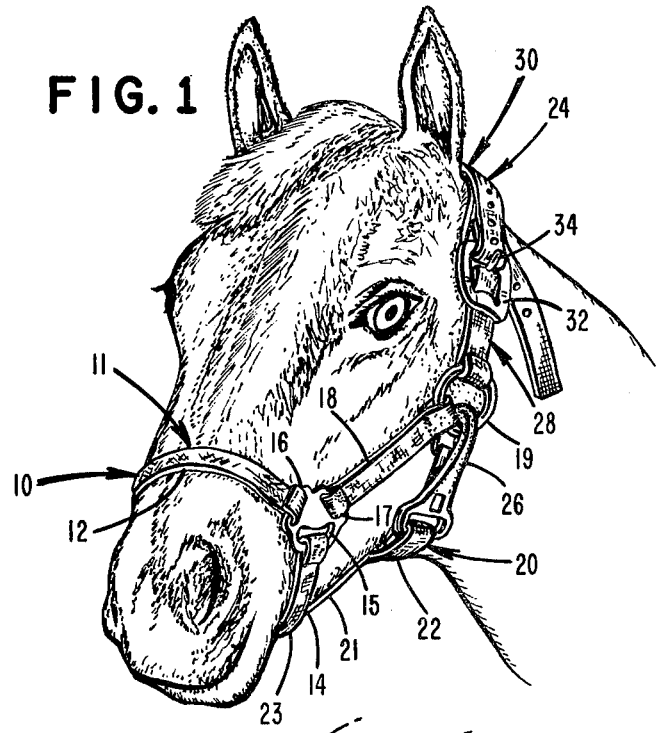
FIG. 1 is a perspective view of the head and neck of a horse having a halter embodying the present invention releasably fastened thereon.
Figure 2:
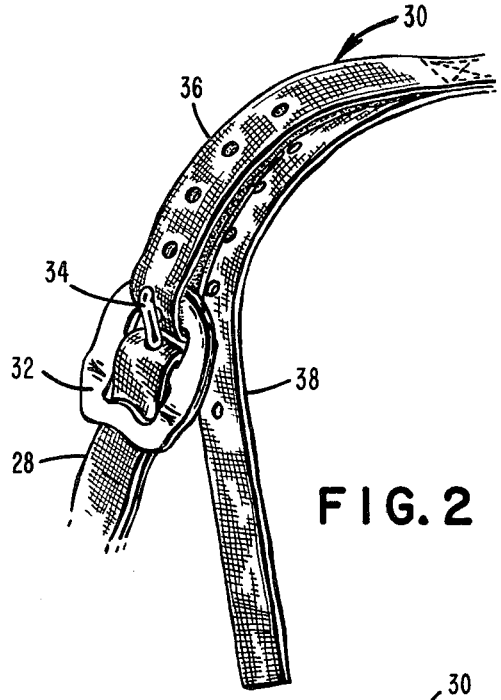
FIG. 2 is an enlarged, partial perspective view showing the portion of the halter containing the releasable fastening device.
Figure 4:
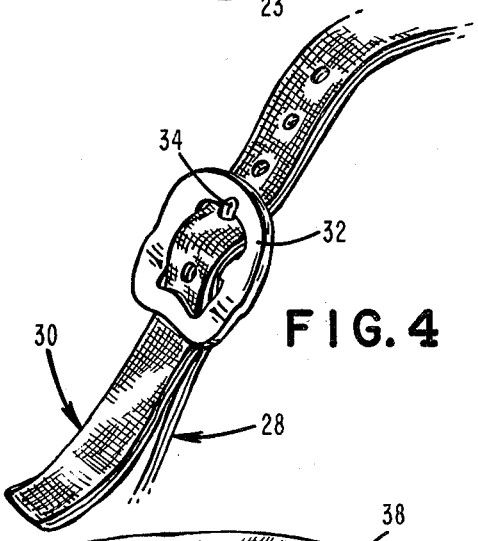
FIG. 4 is an enlarged, partial perspective view showing the free ends of the halter embodying the present invention non-releasably secured to each other.

Referring to FIGS. 1 and 2, the improved halter of the present invention is shown releasably fastened around the head and a portion of the neck of a horse. The halter, which is generally designated 10, comprises a plurality of interconnected straps adapted to be removably mounted upon a horse or similar animal in juxtaposition with the head and neck thereof. The purpose of halter 10, fastened as shown in FIG. 1, is to allow the horse to free itself from the halter. The purpose of halter 10, fastened as shown in FIG. 4, is the same as that of any other halter and, in this respect, perhaps the most sufficient function thereof is in leading and tying the animal. For the most part then, the halter 10 may be substantially conventional in both constructional and functional terms.

The halter 10 includes a nose strap 11 adapted to loosely encircle the nose of the animal leaving sufficient clearance so that the mouth can be opened and closed with substantially no interference. The nose strap 11 is formed in two sections comprising an upper nose covering section 12 and a low jaw-covering section 14. Generally, the sections 12 and 14 are semicircular and at each pair of adjacent ends they are connected with a ring 15 (only one being shown in the drawings) so as to form a substantially endless strap. In the usual case, all of the straps comprising the halter 10 are formed of a flexible material which may be leather, nylon, or other suitable fabric, and although the strap sections 12 and 14 may be secured to the rings 15 in any suitable manner, this is advantageously accomplished by stitching the strap sections in looped form about the rings as is well known in the art. It is observed that the strap section 12 is confined in a translational sense relative to the ring 15 by a special connector section 16 provided thereby. In constrast the strap section 14 is freely moveable about the ring 15 between the limits established by the connector 16 and by second connector section 17 angularly spaced therefrom.

Extending rearwardly from the nose strap 11 is a relatively short face strap 18 which at one end is secured to the connector 17 and at its other end is looped about and secured to a ring 19 that is substantially circular and free of obstructions. It will be appreciated that a face strap 18 and ring 19 are provided along each side of the face of the animal. Secured to the rings 19 is a neck strap, generally denoted as 20. A short jaw strap 21 extends between the nose and neck straps 11 and 20 and is secured to the former by a ring 23 and may be directly secured to the latter by being looped thereabout so that transverse placements of the strap 21 are accommodated at its connection with the neck strap.

The neck strap 20 is of definitive length and has a lower section 22 that hangs somewhat loosely about the neck of the animal and an upper section, generally designated 24, that extends over the top of the head behind the ears of the animal, as shown in FIG. 1. One end of the lower section 22 (not shown) is looped about and secured to a ring (not shown) similar to ring 19. The other end of lower section 22 is attached to a releasable fastener 26. The fastener 26, which is adapted to be connected to ring 19, is provided so that halter 10 can be easily mounted upon and removed from the animal.

Figure 5:
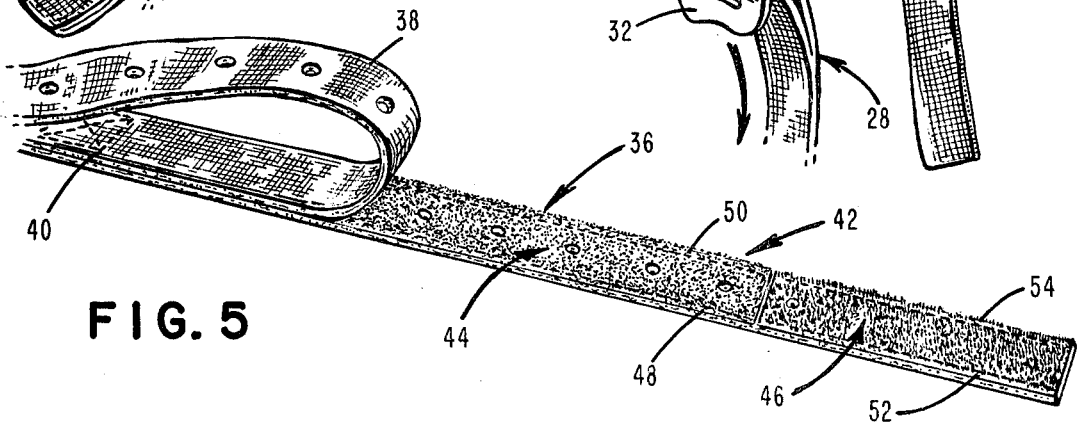
FIG. 5 is an enlarged perspective view showing in detail the two-section releasable fastener used in the present invention.

The upper section 24 is comprised of two parts, designated 28 and 30. Part 28 has one end fixedly connected to ring 19, for instance, by being looped about the ring and stitched. The other or free end of part 28 is connected to a buckle 32 having a catch 34. Part 30 has one end fixedly connected to a ring similar to ring 19 positioned on the side of the horse's head not shown in FIG. 1. The other or free end of part 30, as shown in FIGS. 2 and 5, is formed of two longitudinally-extending overlapping straps 36 and 38 which are connected to each other in an area 40. The first strap, strap 38, has an outer surface adapted to lay against the neck of the animal and an inner surface which faces strap 36. Similarly, the second strap, strap 36, has an inner surface which faces strap 38 and an outer surface facing away from strap 38. Both straps 36 and 38 contain a plurality of aligned holes or openings which are engageable by the catch of buckle 32, as shown in FIG. 4, to non-releasably secure the harness to the head and neck portions of the animal. Stress releasable means, generally designated 42, are attached to one of the surfaces of straps 36, 38 for releasably securing the halter 10 about the head and a portion of the neck of the animal. Straps 36, 38 can also be extended to form the end of part 30 secured to the ring similar to ring 19. In such case, one of the straps is longer than the other and is looped about the ring. Both of the straps are then stitched or otherwise connected to each other to secure part 30 to the ring.

The stress-releasable means 42 can take various forms, but when interconnected, the strap to which they are connected is converted into a substantially endless member adapted to encircle the neck portion of the animal as shown in FIG. 1. The stress-releasable means, as best shown in FIG. 5, includes cooperative components 44, 46 carried by the inner surface of strap 36 which are interlockingly engageable with each other. When interlockingly engaged, they are effective to resist separation upon application of a longitudinal tensile force therebetween generally along the length of the strap and endless member formed thereby until the magnitude of such tensile force approximates a predetermined value. When such force value is reached, separation or rupturing of the interconnected portions occurs.

In FIG. 5, the cooperative components 44, 46 forming the stress-releasable means 42 are shown mounted on the inner surface of strap 36. When the cooperative component 46 is folded over and engaged with the cooperative component 44, the cooperative components resist separation when a longitudinal tensile force is applied therebetween, until such force approaches some predetermined value; however, they are readily separated upon application of a transverse force thereto tending to peel one of the components from the other. More particularly in this respect, if the free end of the strap 36 is grasped at its extremity, and is pulled downwardly toward buckle 32 so as to be peeled from the cooperative component 44, the components 44 and 46 separate with considerable ease, for example, with a pull of just a few pounds. Although the magnitude of the force required to separate the components 44 and 46 by application of a longitudinal tensile force thereto may be varied considerably depending upon requirements, a force value of about 25 pounds is considered optimum for a halter used for a grown horse.

The stress-releasable means 42 comprising the cooperative components 44 and 46 constitutes two strips of material secured to the inner surface of strap 36 so as to be disposed in contiguous facing juxtaposition when the end of strap 36 is folded back on itself to form the endless neck encircling strap. Such strips of material are flexible and non-metallic, cannot injure or cause discomfort to the animal, and the cooperative components comprising the same are readily used and manipulated.

Referring to FIG. 5 in particular, it will be seen that the component 44 and strip of material comprised thereby includes a relatively thin backing sheet 48 secured to strap 36 in any suitable manner as by means of being stitched, stapled, adhesively, or otherwise fixed along one surface thereof in longitudinal disposition with respect thereto. The component 44 further has a facing 50 attached to the backing sheet and the facing constitutes a fibrous mass of relatively high pile nap defining a myriad of looped soft fibers. The component 46 similarly includes a backing sheet 52 fixedly attached to strap 36 in longitudinally extending relation therealong, and projecting from the exposed face of the backing sheet are ordered rows of stiff needle-like hooked shaped locking fingers 54 that are turned laterally at their outer ends so as to interlockingly engage the fibrous mass forming the facing 50 of component 44 when the components 44 and 46 are pressed together. Stress-releasable means having the characteristics described is sold in retail outlets under the name "Velcro."

When it is desired to non-releasably fasten the halter around the head and the portion of the neck of an animal, the catch of buckle 32 is engaged with a selected pair of holes or openings in straps 36 and 38. The halter 10 is then placed upon the horse in the customary manner by engaging the fastener 26 with ring 19 and slipping the nose strap 11 over the muzzle of the horse. Should it be either necessary or desirable to adjust the tightness of the neck strap 20 with respect to the horse, the selected pair of holes or openings in straps 36, 38 engaged by buckle 32 is varied. The halter is then used in the ordinary manner to lead, train or tie the animal without risk of unexpected release of the halter.

Figure 3:
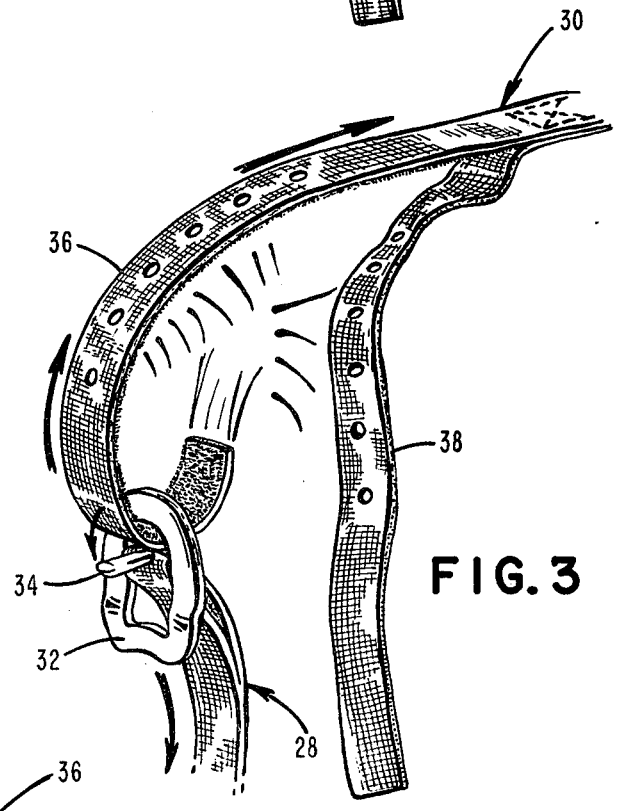
FIG. 3 is an enlarged, partial perspective view showing the free ends of the releasably engaged halter of FIG. 1 in the process of becoming separated from each other.

When it is desired to leave the halter on an unattended animal, the halter is releasably fastened around the head and a portion of the neck of the horse by passing only the strap 36 through the buckle in such manner that the catch of buckle 32 does not engage any of the holes or openings in the strap. The leading portion of the strap 36 passing through the buckle is folded back on strap 36 so that some or all of cooperative component 46 engages cooperative component 44. With cooperative components 44, 46 so engaged, halter 10 can be releasably fastened around the head and a portion of the neck of a horse by engagement of fastener 26 with ring 19. If halter 10 is releasably fastened around the head and a portion of the neck of the animal and either the halter becomes caught in a fence or on some other obstruction of a character that makes it difficult for the animal to free itself therefrom or the animal gets a leg caught in one or the other of the nose strap 11 or neck strap 20, the efforts of the animal either to free itself from the obstruction with which the halter has become entangled or to free its leg from the nose or neck strap of the halter exert sufficient tensile force on the overlapped and interengaged cooperative components 44, 46 of the neck strap so that they are displaced longitudinally relative to each other, as shown in FIG. 3, thereby releasing them and permitting the halter to drop from the animal. The force necessary to cause such separation is adjustable, and in the case of the particular securing means shown and described, the magnitude of the force required to effect breakaway is decreased by reducing the length of the cooperative components 44, 46 in engagement with each other and vice versa. As indicated hereinbefore, a breakaway force requirement of the order of 25 pounds has been found to be adequate for the average full grown horse to permit release of the releasably secured halter 10 when the animal is attempting to extricate itself from a situation in which the halter is entangled in an obstruction.

While in the foregoing specification an embodiment of the invention has been disclosed in considerable detail for purposes of making a complete disclosure thereof, it will be apparent to those skilled in the art that numerous changes can be made in such details without departing from the spirit and principles of the invention. Non-limiting examples of such changes include positioning the stress-releasable means 42 on a surface of the straps 36, 38 other than the inner surface of strap 36, using the fastening device of the present invention with the lower section 22 instead of the upper section 24 of the neck strap 20, attaching the releasable fastener 26 to one of the ends of the upper section 24 connected to the rings 19, and forming openings or holes in only one of the straps 36, 38.

What is claimed:

1. In a halter for an animal having a neck strap including two parts with free ends facing each other, the improvement comprising fastening means moveable between a first position for non-releasably fastening and a second position for releasably fastening the free ends of the two parts to each other and comprising: a buckle attached to the free end of one of the two parts, the free end of the other of the two parts containing a plurality of openings engageable by the buckle for non-releasably fastening the free ends of the two parts to each other; and stress releasable means having a first section containing a relatively high pile nap surface defined by myriad looped soft fibers and a second section longitudinally spaced from the first section having a surface containing opposed rows of stiff hook shaped needle-like locking fingers, the surfaces of the sections when engaged with each other resisting separation until a longitudinal force applied thereto exceeds a predetermined value, the stress releasable means being mounted on the free end of the other of the two parts in such manner that when the free end is passed through the buckle and folded back on the other of the two parts the surfaces of the sections are engaged with each other thereby releasably fastening the free ends of the two parts to each other.

2. In a halter as claimed in claim 1, the improvement wherein the free end of the other of the two parts is formed of two separated longitudinally-extending straps, one of the two straps being adapted to overlap the other when the halter is secured around the animal with an inner surface of the one strap facing the other strap and an outer surface facing away from the other strap and wherein said stress releasable means is mounted on said inner surface of said one strap.

3. In a halter for an animal having a nose strap, a neck strap and face straps connecting the nose strap to the neck strap, the improvement wherein the neck strap includes:

a first part having one end fixedly connected to another part of the neck strap and one end free;

a buckle attached to the free end of the first part;

a second part having one end fixedly connected to another part of the neck strap and a free end facing the free end of the first part, the free end of the second part being formed of two separated longitudinally-extending straps connected to each other at one end, with one of the two straps overlapping the other and having an inner surface facing the overlapped strap and an outer surface adapted to face away from an animal wearing the halter, said two straps containing a plurality of aligned openings near their free ends, said second part being adapted to be non-releasably connected to said first part by the engagement of said buckle with a selected pair of said openings; and stress releasable means attached to the inner surface of the one strap with a first section close to the free end and a second section longitudinally spaced from the first section, one of the two sections having a relatively high pile nap surface formed of a myriad of looped soft fibers and the other of the two sections having a surface with opposed rows of stiff hook shaped needle-like locking fingers, the two sections when engaged with each other resisting separation when a force is applied in a direction along the one strap, the two sections separating when a predetermined force is exceeded, said second part being adapted to be releasably connected to said first part by passing the free end of said one strap through said buckle and folding the free end back on the one strap in said manner that none of the openings in said one strap are engaged by said buckle and said two sections of said stress releasable means are engaged with each other.

4. In a halter as claimed in claim 3, the improvement wherein the predetermined force required to separate the surfaces of the sections of the stress releasable means is adjustable by varying the size of the area of engagement of the surfaces of the two sections with each other.

* * * * *